United States Patent [19]

Schmanski

[11] 4,338,041

[45] Jul. 6, 1982

[54] GLAREFOIL ASSEMBLY

[76] Inventor: Donald W. Schmanski, P.O. Box 1298, Carson City, Nev. 89701

[21] Appl. No.: 224,261

[22] Filed: Jan. 12, 1981

[51] Int. Cl.[3] ..... E01F 9/00

[52] U.S. Cl. ..... 404/9; 256/13.1; 40/608

[58] Field of Search ..... 404/9, 10, 6; 256/13.1, 256/1; 40/607, 608

[56] References Cited

U.S. PATENT DOCUMENTS

| | | | |
|---|---|---|---|
| 2,572,451 | 10/1951 | Custer | 404/9 X |
| 2,974,934 | 3/1961 | White | 256/13.1 |
| 3,004,145 | 10/1961 | Kroes | 256/13.1 |
| 3,096,079 | 7/1963 | Winn | 256/13.1 X |
| 3,114,303 | 12/1963 | Oberbach | 256/13.1 X |
| 3,847,497 | 11/1974 | Guillory | 404/10 |
| 4,186,913 | 2/1980 | Bruner | 256/13.1 |
| 4,228,867 | 10/1980 | Wirt | 256/13.1 X |
| 4,249,832 | 2/1981 | Schmanski | 404/9 X |

*Primary Examiner*—Nile C. Byers, Jr.
*Attorney, Agent, or Firm*—Thorpe, North & Western

[57] ABSTRACT

A glarefoil assembly for mounting to a median barrier which divides opposing lanes of a highway system and operates to reduce the glare of headlights from oncoming vehicles. The glarefoil assembly includes a plurality of glare blades which are rigidly attached to a base section in an appropriate light-blocking orientation. The base section is rigidly mounted to the top of the median barrier at opposing ends, thereby preserving some latitude for vibrational movement within this base section. By virtue of the rigid attachment between the glare blades and base section, along with the compatible elastic moduli of these materials, the glarefoil assembly operates as an integral unit providing energy transfer from the glare blades into the base section. Such energy transfer prevents material failure developed by pulsating winds which typically arise from passing traffic.

16 Claims, 7 Drawing Figures

GLAREFOIL ASSEMBLY

BACKGROUND OF THE INVENTION

1. Field of the Invention

The present invention relates to a glarefoil assembly for reducing headlight glare from oncoming traffic along a divided highway. More particularly, the invention relates to a glarefoil assembly having the novel capability of dissipating energy absorbed from various external sources throughout the entire assembly to decrease the possibility of deformation or failure of the assembly and thus substantially increase its lifetime.

2. Prior Art

The problem of blinding headlight glare along divided highways has resulted in many attempts to reduce this driving hazard. Plants and shrubs have been planted along the top of the median barrier separating the divided lanes to block out the glare from oncoming traffic. This method proved unsatisfactory due to the time-consuming care and attention needed to keep the plants alive and trimmed, as well as the often long waiting periods accompanying the initial growth of the plants. Furthermore, exposure of crew personnel to the high speed traffic of freeway systems creates a severe safety risk while trimming and maintaining foilage.

Another attempt to solve the glare problem consists of an aluminum screen mounted to steel posts along the top of the median barrier. The screen is effective in eliminating headlight glare, but maintenance difficulties make this method impractical. The screens would often come loose and sag when buffeted by the wind and air currents created by passing automobiles. Projecting objects from cars and trucks would often catch the screen and tear large holes or otherwise damage the screen. Such screens were also subject to mischief in the form of thrown objects such as pop bottles or rocks which develop large holes in the screen, necessitating further maintenance. Often in repairing even small holes in the screen, large whose sections of screen had to be replaced, thus adding to labor and material costs.

The screens also created a barrier for police, ambulance and other emergency vehicles and personnel that need quick access across the highway in times of accident or emergency. Often, large holes must be cut in the screen to enable quick response. This not only causes critical delays in treating accident victims and in responding to emergencies, but also necessitates additional cost in later reparations of the screen.

The latest attempt to eliminate the problems caused by the screens resulted in glarefoils which are individually mounted on the top of the median barrier. These glarefoils, sometimes referred to as paddles, are typically elliptical in shape extending up to 4 feet above the median barrier and are commonly made of polyethylene or other thermoplastic material. These glarefoils preserved cross access over the divider and solved some of the maintenance problems associated with the screens. Also, the flexibility of these glarefoils allows them to yield upon impact by protruding or thrown objects and then recover their original shape and position.

Many disadvantages, however, soon became apparent with the individual glarefoil system. Typically, each glarefoil is individually mounted to the median barrier by several bolts. Thus, the installation or removal of each glarefoil is timely and therefore costly. Also, the thermoplastic glarefoils become brittle when exposed to extreme temperatures and ultraviolet radiation from the sun. Furthermore, it has been noted that these glarefoils often break off at the bolt mountings when constantly buffeted by the wind or the everyday air currents from passing cars. Therefore, although the individual glarefoil system helped solve part of the problem of absorbing energy from an occasional random impact they failed to deal with the problem of absorbing the everyday vibrational energy caused by wind and passing cars.

A more detailed description of the prior art has been cataloged and summarized in a publication of the Transportation Research Board of the National Research Counsel in cooperation with the Federal Highway Administration, entitled "Glare Screen Guidelines." This report is dated December 1979 and is available from the Transportation Research Board of the National Academy of Sciences, Washington, D.C. In addition to outlining the various types of glare screen devices, the report lists a number of desirable functions which an effective glare screen should provide. These include:

1. Effectively reduce glare
2. Involve simple installation procedures
3. Be resistant to vandalism and vehicle damage
4. Be adapted for quick and safe repair
5. Require minimal cleaning and painting
6. Incur minimal accumulation of litter and snow
7. Be resistant to winds
8. Provide reasonable cost for purchase and maintenance
9. Include good appearance and provide emergency access to opposing lanes In addition to the foregoing needs, it should be noted that effective glarefoil assembly must be capable of absorbing and dissipating substantial amounts of vibrational energy which result from the constant everyday buffetings of the wind, as well as impact from vehicles and other objects.

BRIEF SUMMARY OF THE INVENTION

The glarefoil assembly of the present invention includes a plurality of light obstructing members and means for mounting them to the top face of a base runner section to form an integral, modular structure. The bottom face of the base runner section is attached to the top of a median barrier. Succeeding base runner sections are mounted end to end in series to form a continuous glarefoil array along any distance desired. Since the base runner is installed in sections with several light blocking members mounted to each section, installation and removal is much more expeditious and inexpensive than the individual glarefoil system which requires individual mounting.

The base runner also functions to receive vibrational energy which is absorbed by the light obstructing members. This is facilitated by constructing the base runner and light obstructing members of flexible materials having mutually compatible elastic moduli, and by firmly securing the light blocking members to the base runner. When the light obstructing members are buffeted by the wind, some of the resultant vibrational energy is transferred to the base runner which then also vibrates. This vibrational energy is transferred into the base runner in the form of wave motions or vibrations which are superimposed on other vibrations within the base runner from other light obstructing members, as well as rebound energy from the mounted ends of the base runner. The effect of superimposition of nonharmonic vibrations within the base runner results in a cancellation of part of the vibration energy as opposing waves traverse the base runner. This dissipation of vibrational energy relieves the glarefoil assembly of a portion of the vibrations within the glarefoil which would otherwise tend to concentrate at local points of stress where the light obstructing members are attached to the base runner, thus greatly reducing the risk of failure. The light obstructing members are rigid enough to stand upright with respect to the base runner, but are also flexible enough to yield to the impact of an object and then restore themselves to their original positions. Thus, the present invention is capable of absorbing and dissipating both impact energy and everyday vibrational energy, and as a result has a longer life expectancy.

It is therefore an object of the present invention to provide a glarefoil assembly that is easy and inexpensive to install and remove and which requires little maintenance, thus greatly reducing labor time and costs.

It is a further object of the present invention to provide a glarefoil assembly which is capable of absorbing and dissipating recurring vibrational energy as well as impact energy so as to greatly reduce the risk of deformation or failure and thus increase the lifetime of the assembly.

It is yet another object of the present invention to provide a glarefoil assembly which is capable of receiving vibrational energy so as to greatly reduce the risk of deformation or failure and thus increase the lifetime of the assembly.

It is yet another object of the present invention to provide a glarefoil assembly which is capable of receiving vibrational energy and dissipating this energy throughout the entire glarefoil assembly, while reducing vibrational effects therein.

It is still another object of the present invention to provide a glarefoil assembly which is easy and inexpensive to manufacture and assemble.

These and other objects will be obvious to one skilled in the art in view of the following detailed description, taken with the accompanying drawings, wherein like numerals designate like parts throughout.

DETAILED DESCRIPTION OF THE INVENTION

Figure 1:
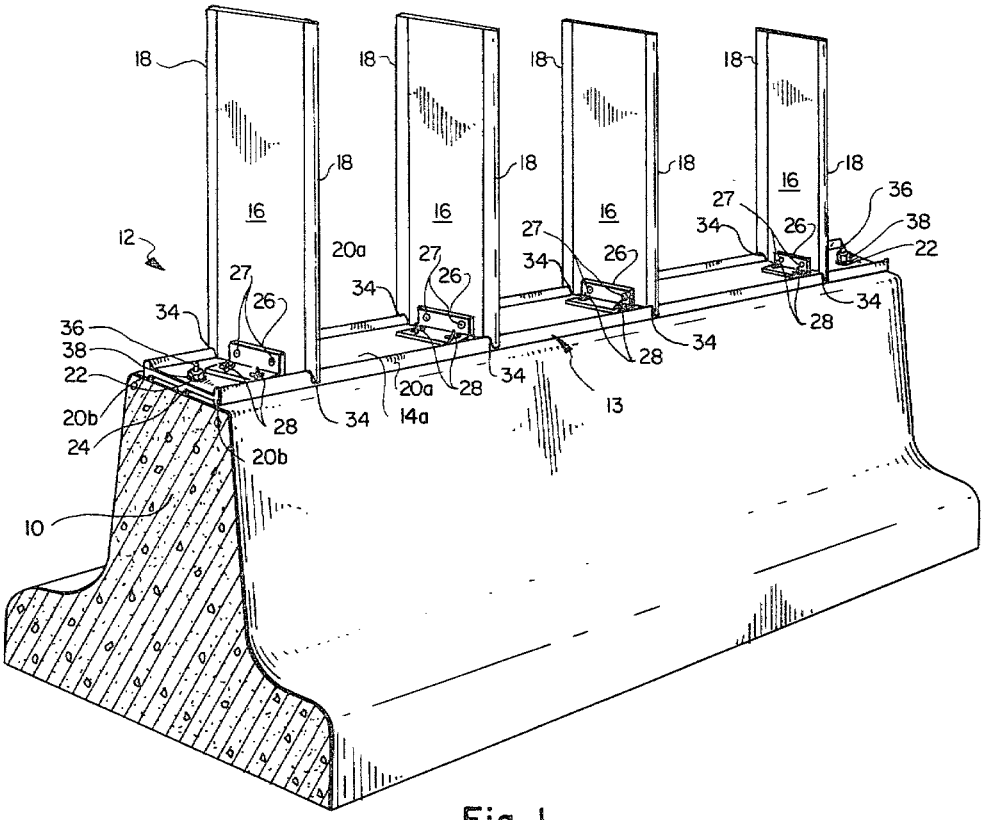
FIG. 1 is a perspective view of the glarefoil assembly of the present invention, shown mounted to a median barrier.

As noted in the prior art description, a recurring problem which individually mounted glarefoil members has been failure of the thermoplastic material at the point of attachment to the median barrier. The remedial action against such failure has usually consisted of attempting to reinforce or strengthen this point of attachment to thereby prevent future cracking. Although such steps help to prolong the life of the glarefoil, they do not deal with the problem or overcome the result of material failure.

An integral part of the present invention includes the discovery that in a typical highway environment of passing high speed traffic, pulsating air currents develop which set the glarefoils into a state of mild vibration which may often be barely noticeable. Over extended periods of time, however, this seemingly trivial energy is concentrated at an immovable bolt location where the glarefoil is attached to the concrete median. Because of the extreme high modulus of the concrete and steel mounting bolt, the vibrational energy remains in the glarefoil until dissipated.

In contrast to the steel bolt and concrete of the median, the plastic of the glarefoil is flexible. At the point of attachment, therefore, there is an extreme mismatch in modulus of elasticity which eventually leads to material failure around the bolt attachment location. The present invention provides for partial translation of this vibrational energy out of the glarefoil and into an elongated base member to thereby reduce the degree of vibrational movement at mounting bolt locations. Furthermore, the effects of the transferred vibrational energy are reduced by the fact that this energy is propagated into the base member in the form of waves which superimpose over waves from other light blocking members and thereby cause a partial cancellation or "interference" of superimposed waves.

Although this principal of interference between nonharmonic waves is a well known part of wave theory, the present inventor is unaware of any application of this theory as a solution to reduce failure rate of individually mounted glarefoil paddles. In fact, since these paddles have always been mounted individually to a concrete median barrier, and since the modulus of the concrete is totally incompatible with the lower modulus of the attached glarefoil paddle, there has been a clear absence of consideration of nonharmonic interference as a means of reducing vibrational energy between two separate glarefoil paddles.

More specifically, as pulsating winds continuously subject the glarefoil to mild vibrational movement, these vibrations are transmitted into the base member through a rigid coupling (explained hereinafter) which sets up vibrational movement within the base member which can be evaluated by classical wave theory analysis. Because at least two of these glarefoils are attached to a single base runner, vibrational or wave-like motion is propagated into the same base member in a nonharmonic manner. As these nonharmonic waves traverse the base member, the respective wave patterns from each glarefoil are superimposed and operate to reduce vibration wherever nodes intersect valleys and thereby cancel out actual vibrational energy. Despite this cancellation, however, energy dissipation continues within the base member. Simply stated, the attachment of a plurality of light obstructing members to a single base member permits the obstructing members to cooperatively reduce the actual vibrational energy developed in the base member, as compared to vibrational energy which would require dissipation if each obstructing member were attached to an independent and separate base member alone. In a very real sense, therefore, a synergistic effect arises wherein the benefit exceeds the sum of the individual contributions made by the inventive structure. Mathematically, this could be illustrated in a glarefoil assembly with four blades attached to a single base member in the following manner. Assuming that each blade of comparable material composition and geometric configuration transmits an equal amount of vibrational energy (x) into the base member, the total vibrational energy being transferred therefore equals 4x. Since, however, a portion of this vibrational energy is cancelled out in effect by interference between the wave motions which traverse the base member in an effort to dissipate energy, the actual vibration experienced by the base member equals 4x minus y, where y equals the actual amount of vibrational energy which was cancelled by way of interference between respective waves within the base member.

This interference pattern is specifically facilitated by matching the compliance of the base member with that of the glare blades. This tends to reduce reflectional vibrations such as experienced by the conventional plastic glare blade as it vibrates against a rigid concrete median barrier.

Figure 2:
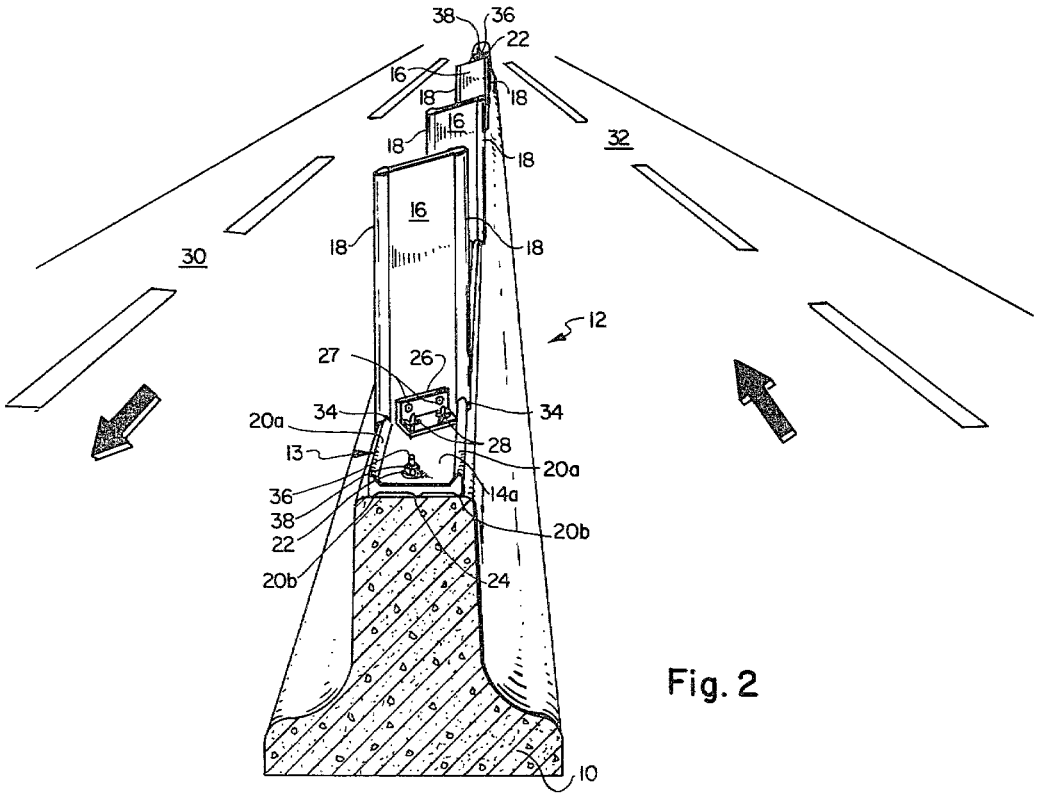
FIG. 2 is an end perspective view of the glarefoil assembly shown in position along a divided highway.

An embodiment of this glarefoil assembly is generally designated 12 in FIGS. 1 and 2. Elongated light obstructing members 16 (also referred to herein as glare blades) are mounted to an elongated base runner section generally designated 13 at the top face 14*a* thereof, with angular support plates 26 providing the means for rigid attachment thereto. The bottom face 14*b* of base runner 13 is attached to a median barrier 10 along a divided highway represented by traffic lanes 30 and 32.

Angular support plates 26 operate as rigid attachment means between the glare blades 16 and base runner 13. Although the figures illustrate the use of pop rivets 27 and 28, it will be noted that angular support plates 26 could be directly epoxied to glare blades 16 and base runner 13. Also, it will also be apparent that where minimal impact or vibrational energy is expected, glare blades 16 could be directly epoxied to top face 14*a* of base runner 13 without the need for angular support plates 26. Typically, angular support plates 26 are made of aluminum and add strength to the assembly as well as facilitate the transfer of vibrational energy as will be explained later. Other rigid metals or plastics could be used, provided they meet the strength requirement and facilitate the referenced energy transfer to the base runner section.

Figure 3:
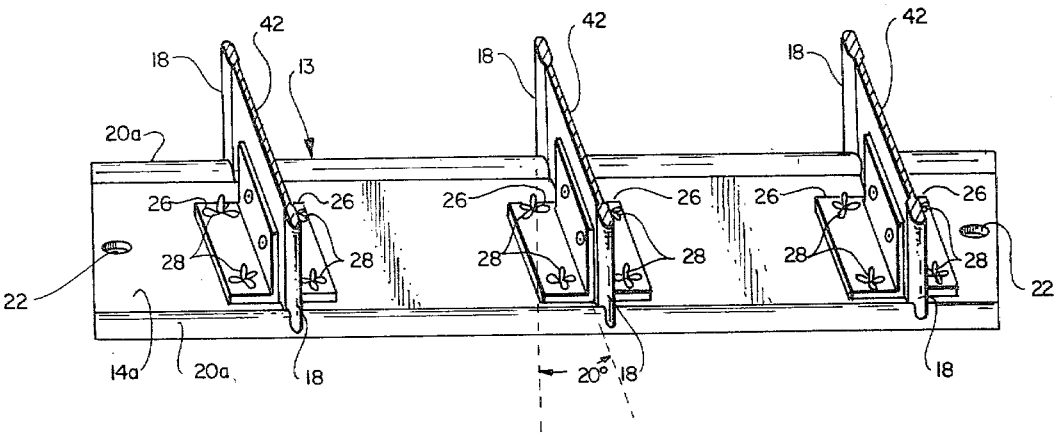
FIG. 3 is a top plan view of the glarefoil assembly.
Figure 4:
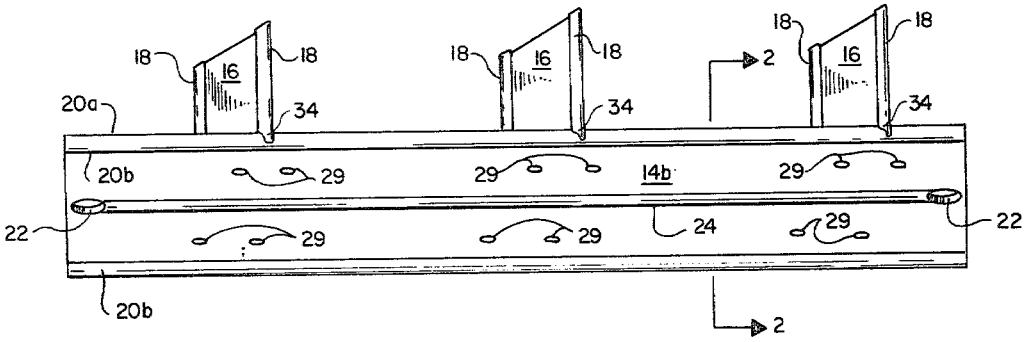
FIG. 4 is a bottom perspective view of the glarefoil assembly.

Strengthening ribs 18 located at the edges of glare blades 16 provide rigidity and form an I-Beam configuration with the web section 42 of the glare blades 16. (See FIG. 3) As best shown in FIGS. 1, 2 and 4, the ends of strengthening ribs 18 interlock with slots 34 in securing ribs 20*a* located at the edges of base runner 13. Securing ribs 20*a* extend upward from top face 14*a* and provide extra contact of glare blades 16 with base runner 13 in better securing glare blades 16 thereto. Securing ribs 20*a* also provide a more efficient energy path for the transfer of vibrational energy from glare blades 16 to base runner 13, as will be explained later.

Directly adjacent securing ribs 20*a* are reinforcement ribs 20*b* which are also located at the edges of base runner 13 and extend downward from bottom face 14*b*. A spacing means such as rib 24 located in the center of bottom face 14*b* cooperates with reinforcement ribs 20*b* to displace the bottom face 14*b* from the median barrier 10 and thereby accommodate the heads 29 of pop rivets 28 in the space therebetween, while at the same time providing a rigid mounting site. It will be noted that an object such as a washer may also be used as the spacing means 24 to enable rigid attachment of the base runner 13 against median barrier 10 and provide a space to accommodate pop rivet heads 29.

Base runner section 13 is of sufficient length to permit a substantial receipt of vibrational energy from attached glare blades 16. As the wind and air currents from passing automobiles cause the glare blades 16 to vibrate, part of the vibrational energy is transferred through the rigid attachment means into the base runner, where it is dissipated. This is opposed to the prior art structure in which energy transfer was minimal due to the comparatively high modulus (E) of the median barrier to which the glare blades were directly mounted.

As indicated previously, the present invention provides for dissipation of vibrational energy throughout the glarefoil structure, and particularly into the base runner. The transfer of vibrational energy from glare blades 16 to base runner 13 is facilitated by making the glare blades, the base runner section and the angular support plate 26 or other attachment means of materials whose physical characteristics enhance their capability to transfer vibrational energy. Elastic modulus and moment of inertia are two such physical characteristics which can be exploited to more easily effect such a transfer. By matching elastic modulus of the glare blade to that of the base runner, reflection of vibrational energy back into the glare blade is reduced. Instead, the vibrational energy is carried directly into the base runner in accordance with well known wave propagation theory. With respect to the second element of moment of inertia, its use in the present structure is primarily for the purpose of developing rigidity to improve the support and resilience of the glare blade and base member portions of the glarefoil assembly. This more rigid structure tends to enhance the propagation of vibrational waves in the same manner that a taut string or rubber band has better wave transmittal characteristics than a loose string. Just as the taut string has resilience to maintain propagation of the wave, the use of ribs and other reinforcing structure which increase moment of inertia operate to improve resilience and transmittance of vibrational energy.

In the illustrated embodiment, the glare blades 16 and base runner 13 are made of fiberglass or fiber reinforced plastic. The elastic modulus of fiberglass composite (approximately 1–6 million) is well adapted for such a glarefoil assembly because it has inherent rigidity and weatherability to remain functional, yet it can be structured to withstand random impacts from passing vehicles or objects without incurring immediate need for maintenance. Such fiberglass composite material can also be pultruded or otherwise formed into various geometric cross-sections to maximize opposing characteristics of flexibility and rigidity at minimal cost. See for example, U.S. Pat. No. 4,092,081. As is explained hereafter, these geometries can be applied to both the upright member 18 and the base member 13 to facilitate a rigid attachment therebetween. This closer matching of elastic moduli results in a much more efficient dissipation of energy from the glareglades 16 to the base section. It will be apparent to one skilled in the art that, in addition to the fiber reinforced plastics, many different rigid materials having similar high elastic moduli can be used within the subject glarefoil system to effect the same transfer of vibrational energy.

As previously mentioned, moment of inertia can also be used to effect a better transfer of vibrational energy within glarefoil assembly 12. As previously indicated, the moment of inertia of an object is determined largely by its geometric configuration. The rectangular cross-section of the base runner illustrated in FIG. 5*a* typically will have only one primary mode of vibration in a glarefoil assembly of the present invention. This is indicated by arrows 3 and 3', respectively as an up and down direction.

Figure 5A:
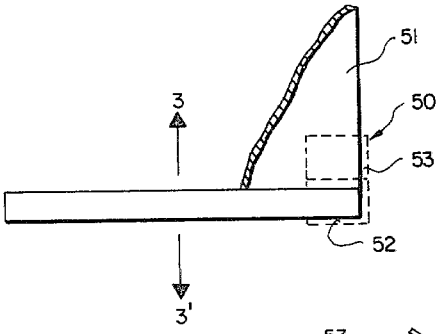
FIG. 5*a* is a cross-sectional view of a rectangular base runner of the glarefoil assembly with a segment of an upright light obstructing member and fastener shown in phantom lines.
Figure 5B:
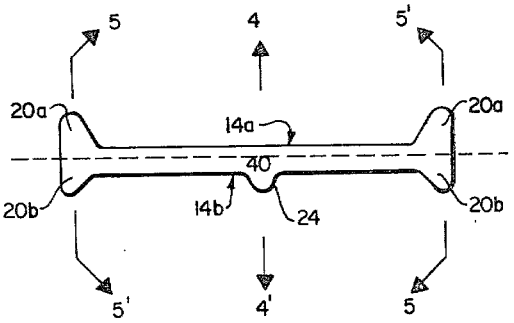
FIG. 5*b* is a cross-sectional view of the base runner of the glarefoil assembly of FIG. 4 taken along line 2—2, showing the Tri-Beam configuration of the base runner.

By configurating base runner 13 to have a moment of inertia which facilitates multiple modes of vibration, its ability to receive vibrational energy from the glare blade 16 will be greatly enhanced. FIG. 5*a* shows such a configuration, that of an I-Beam or modified Tri-Beam. Not only does the I-Beam configurated base runner 13 of FIG. 5*b* have a vertical mode of vibration as indicated by arrows 4 and 4', but it also develops a rotational mode of vibration indicated by arrows 5 and 5'. This configuration is achieved by having a thin web section 40, in conjunction with securing ribs 20*a* and reinforcement ribs 20*b*. The web section 40 has a low moment of inertia which improves flexibility. By combining this structure with the more rigid ribs at the edges of the structure, rotational flexing is developed to assist in energy dissipation.

The strengthening ribs 18 of glare blades 16 also employ this concept. Strengthening ribs 18 form an I-Beam configuration with thin web section 42, as best seen in FIG. 3. The additional vibrational modes created by joining strengthening ribs 18 to web section 42 enhances translation of multiple modes of energy transfer to the base runner section. This method of energy transfer also avoids excessive concentration of stress at local sites and therefore reduces the rate of wear toward failure.

Another important feature of the glarefoil assembly 12 is the use of securing ribs 20*a* which provide improved rigid contact between the glare blades 16 and the base runner 13. Not only does the extra contact provide enhanced stability to the upright member, but it also provides more effective contact area between the ribbed portions of the respective glare blades 16 and base runner 13. This integral contact between the more rigid rib portions tend to make the subject glarefoil assembly respond to energy vibration as a single, integral unit.

Although such contact is shown in the drawings as being achieved by means of slots 34 in securing ribs 20*a*, a slot extending across face 14*a* to accomodate the entire end of a glare blade 16 is also possible. Such a slot would provide even more integral contact by glare blade 16 with base runner 13 and effect an even better transfer of vibrational energy therebetween.

The same contact principle is true with respect to angular support plates 26. In providing additional contact and support with glare blades 16 and base runner 13, angular support plates 26 also provide an additional energy path for dissipating vibrational energy from the glare blade 16 to the base runner 13.

Figure 6:
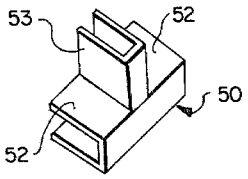
FIG. 6 depicts a slotted fastener used to assemble the glarefoil components.

It should be noted that even the less desirable flat slat structure of FIG. 5*a* can be adapted as a modular glarefoil system by use of a slotted fastener 50 as shown in FIG. 6 to stabilize an upright member 51. In this instance, the base runner is fastened in the slots of the lateral segments 52 as shown in FIG. 5*a*. The upright member is coupled to the base section by attachment into the slot of the vertical fastener segment 53. This combined structure can then be cemented or epoxied at all contact points between the upright and base members to further enhance the rigidity of the attachment.

The installation of glarefoil assembly 12 to median barrier 10 can be accomplished in many different ways. One simple method is to drill holes in the concrete median barrier and insert an iron stud 36. Holes 22 in corresponding position to the studs 36 are drilled in the base runner 13. The studs 36 are then inserted into holes 22 and the assembly 12 is then firmly secured to median barrier 10 by means of washers and steel nuts 38. A possible alternative method of installation would be to epoxy the ends of the base runner 13 or ribs 20*b* and 24 directly to the median barrier 10.

The orientation and spacial separation between each glare blade may vary, depending on the width of the blade and the relative angle of implacement with respect to the longitudinal axis of the base runner. It should be apparent that wider glare blades will enable greater spacial separation. Furthermore, the maximum spacial displacement between adjacent glare blades will be a function of blade orientation, since the blades must effectively block out all opposing headlight glare during close visual proximity between passing cars.

As stated in the previously referenced article entitled "Glare Screen Guidelines" a twenty degree cutoff angle has been established generally as the minimum offset for the glare blade from an axis ninety degrees to the longitudinal axis of the line of traffic. This minimum cutoff angle is primarily the product of safety research of state and federal highway authorities.

Using this twenty degree minimum, maximum spacial displacement can be calculated by trigonometric relationships. Since the twenty degree glare blade forms one side of a right triangle, whose hypotenuse is the distance to the next glare blade, the value of the hypotenuse will depend upon the width of the glare blade. For a six inch glare blade, the optimum distance between blades is 17.54 inches. A nine inch glare blade has an optimum distance of 26.31 inches. Typical dimensions for the glarefoil assembly illustrated in FIG. 1 are as follows:

| | | |
|---|---|---|
| Length of base runner | 10–20 | ft |
| Width of base runner | 4–6 | in |
| Thickness of ribs on base | .250–.50 | in |
| Thickness of web section | .09–.250 | in |
| Length of glare blade | 12–48 | in |
| Width of glare blade | 4–9 | in |
| Thickness of ribs on upright member | .125–.375 | in |
| Thickness of web section | .09–.175 | in |
| Spacial distance between adjacent glare blades | 15–25 | in |
| Thickness of spacing rib | .250–.50 | in |

It will be apparent that the structure disclosed by the preferred embodiment herein is only illustrative and should not be considered as the only structure suitable for carrying out the subject invention. It should therefore be understood that the present disclosure is by way of example only and that variations are possible without departing from the scope and spirit of the hereinafter claimed subject matter, which subject matter is to be regarded as the invention.

I claim:

1. A glarefoil assembly for mounting to a median barrier along a divided highway, comprising:

at least one elongated base runner section having a bottom face for attachment to said median barrier and a top face opposing said bottom face, said base runner section having sufficient length to accept a substantial transfer of vibrational energy from an attached external source;

at least two elongated glare blades adapted for reducing headlight glare from oncoming traffic along said divided highway; and rigid attachment means coupled to one end of each of said glare blades and to said top face of said base runner section such that said glare blades are in upright light blocking orientation with respect to a projected median barrier location, said glare blade, said base runner section and said attachment means having material compositions whose physical characteristics permit transfer of substantial vibrational energy from said glare blades into said base runner section to assist in dissipation of said vibrational energy.

2. A glarefoil assembly as defined in claim 1, wherein at least four of said glare blades are rigidly attached at one end to the base runner section, the base runner section forming an integral unitary structure with said glare blades mounted thereto, said glare blades being spaced apart and oriented along each base runner section so as to maximize the amount of headlight glare obstructed by said glare blades while minimizing the amount of surface area of said glare blades needed for the obstruction.

3. A glarefoil assembly as defined in claim 1, further comprising at least one securing rib located at an edge of said base runner section and extending upward from said top face, said securing rib having a slot which interlocks with the end of said glare blades and provides additional contact of said glare blade with said base runner section to better secure said glare blade thereto and provide a more efficient path for transfer of said vibrational energy from said glare blades to said base runner section.

4. A glarefoil assembly as defined in claim 1, further comprising at least two reinforcement ribs located at edges of said base runner section and extending downward from said bottom face.

5. A glarefoil assembly as defined in claim 4, further comprising means for spacing said bottom face away from said median barrier while at the same time providing a rigid mounting site for attachment at a mounting stud projecting from said median barrier.

6. A glarefoil assembly as defined in claim 1, wherein said rigid attachment means is an angular support plate.

7. A glarefoil assembly as defined in claim 6, wherein said angular support plate is mounted to said base runner section by pop rivets.

8. A glarefoil assembly as defined in claim 7, further comprising at least two reinforcement ribs located at the edges of said base runner section and extending downward from said bottom face and a spacing rib situated on said bottom face, said spacing rib cooperating with said reinforcement ribs to accommodate said pop rivets in the space between said bottom face and said median barrier.

9. A glarefoil assembly as defined in claim 1, wherein said glare blade is mounted to said base runner section at an angle of at least about seventy degrees with respect to the axis formed by said elongated base runner section.

10. A glarefoil assembly as defined in claim 1, wherein said base runner section and said glare blade are nonreflective.

11. A glarefoil assembly as defined in claim 1, wherein said base runner section and said glare blade are made of plastic materials having elastic moduli which are mutually compatible for the transfer of vibrational energy from said glare blades to said base runner section.

12. A glarefoil assembly as defined in claim 1, wherein said base runner section and said glare blades are made of fiber reinforced thermosetting resin, said reinforcement including longitudinal fibers and fibers in a transverse direction with respect to the longitudinal axis.

13. A glarefoil assembly as defined in claim 1, wherein said base runner section is configurated to have a geometric configuration that increases the number of modes of vibration of said base runner section and thereby enhances its ability to receive said vibrational energy from said glare blade, and to result in partial nonvibrational dissipation thereof by reason of nonharmonic overlap of vibrational propagations from each glare blade.

14. A glarefoil assembly as defined in claim 13, wherein said base runner section has an I-Beam configuration.

15. A glarefoil assembly as defined in claim 1, further comprising strengthening ribs located at the edges of said glare blades to provide rigidity, said glare blade having a thin web section between said strengthening ribs and forming an I-Beam configuration therewith.

16. A glarefoil assembly as defined in claim 1, wherein said rigid attachment means comprises a slotted fastener which clips the glare blade in rigid upright attachment to the base section along the respective sides thereof.

* * * * *